United States Patent [19]

Du Preez

[11] Patent Number: 4,760,993

[45] Date of Patent: Aug. 2, 1988

[54] SNATCH BLOCK

[75] Inventor: Hercules P. Du Preez, Alberton, South Africa

[73] Assignee: Deton Engineering (Proprietary) Limited, Transvaal, South Africa

[21] Appl. No.: 5,368

[22] Filed: Jan. 13, 1987

Related U.S. Application Data

[63] Continuation of Ser. No. 747,057, Jun. 20, 1985, abandoned.

[30] Foreign Application Priority Data

Jun. 22, 1984 [ZA] South Africa ..... 84/4739

[51] Int. Cl.[4] ..... B66D 3/04

[52] U.S. Cl. ..... 254/411

[58] Field of Search ..... 254/390, 402, 403, 405, 254/409, 411

[56] References Cited

U.S. PATENT DOCUMENTS

| | | | |
|---|---|---|---|
| 807,994 | 12/1905 | Beck | 254/409 |
| 973,177 | 10/1910 | Davis et al. | 254/409 |
| 1,033,354 | 7/1912 | Simmons | 254/409 |
| 1,145,110 | 7/1915 | Ball | 254/405 |
| 1,158,385 | 10/1915 | Mears | 254/405 |
| 1,243,847 | 10/1917 | McGiffert | 254/405 |
| 1,650,904 | 11/1927 | McKissick | 254/402 |
| 1,736,193 | 11/1929 | Erdahl | 254/411 |
| 1,817,949 | 8/1931 | Smith | 254/409 |
| 1,952,940 | 3/1934 | Rabelos | 254/390 |
| 2,254,828 | 9/1941 | Linn | 254/411 |
| 2,269,768 | 1/1942 | Keeney | 254/405 |
| 2,464,451 | 3/1949 | Keeney | 254/405 |
| 3,199,841 | 8/1965 | McKean | 254/411 X |
| 3,275,301 | 9/1966 | Read | 254/405 |

*Primary Examiner*—Stuart S. Levy
*Assistant Examiner*—Joseph J. Hail, III
*Attorney, Agent, or Firm*—Merchant, Gould, Smith, Edell, Welter & Schmidt

[57] ABSTRACT

The invention provides a snatch block of the type having a sheave rotatably mounted between a pair of cheek plates with a suspension eye for anchoring the snatch block secured to the cheek plates, characterized in that opposed sides of the cheek plates between the suspension means and sheave access are angled outwardly to provide a V-shaped entry to the sheave for a cable, chain or the like. Another feature of the invention provides for inwardly directed lip formations to be defined at the upper ends of the cheek plates to prevent the cable on the sheave from riding upwardly into the suspension eye.

7 Claims, 4 Drawing Sheets

SNATCH BLOCK

This is a continuation of application Ser. No. 747,057, filed June 20, 1985, now abandoned.

THIS invention relates to a snatch block, pulley or the like.

Conventional snatch blocks comprise a sheave mounted between opposed cheek plates, the snatch block being suspended in use from an eye formation which bridges the cheek plates. A problem encountered with such conventional snatch blocks is that as a result of the weight of the snatch block it does not readily swing into horizontal position in use. As a result a cable on the sheave often rides up into the eye formation and causes considerable wear.

An object of the present invention is to provide a novel snatch block, pulley or the like which it is believed will at least to some extent alleviate the problem described above.

According to the invention a snatch block, pulley or the like comprises a sheave member rotatably mounted on a cheek plate, means on the cheek plate for suspending the snatch block in use, the arrangement being one wherein opposed sides of the cheek plate which flank the suspension means are angled away from the sheave.

Preferably the sheave will be mounted between a pair of spaced cheek plates and the opposed sides of each cheek plate will be angled in the manner described above, to provide a V-shaped entry to the sheave for a cable, chain or the like.

Preferably the angled sides of the cheek plates will extend to substantially the axis of the sheave. Below such axis the cheek plates will have a width adjacent the top closure plate (width as measured across the face of the plate orthogonal to the axis) which will preferably taper downwardly towards the lower zone of the sheave. As shown in the figures, the maximum width of the cheek plates is greater than the diameter of the sheave at its upper end adjacent the closure plate.

Also according to the invention the one or more reinforcing ribs, flutes or the like are provided on the outer surfaces of the cheek plates to extend between the angled sides. Preferably reinforcing ribs are also provided on the outer surfaces of the cheek plates to extend from the suspension means to the zone of the axis of the sheave.

A further feature of the invention comprises the provision of closure means which are adapted to reduce the opening between the cheek plates intermediate the sheave and the suspension means. In one arrangement such closure means will be in the nature of a plate which mates with the upper edge of the cheek plate. Preferably therefore the upper edge of the cheek plate will be substantially linear.

In one example according to this aspect of the invention the closure member will be hinged to one cheek plate for pivotal movement between a closed position wherein it bridges the cheek plates and an open position wherein it permits lateral access to the sheave. In such an arrangement a common hinge may serve to pivotally mount the suspension means in the form of an eye formation which is also adapted to bridge the sheave. A second and similar opposed hinge may be provided to lock the closure member and suspension eye in the closed position, with the hinge pin of the second hinge being removable to permit these members to move to the open position.

In an alternative arrangement the closure means will define an inwardly directed lip formation on one or both cheek plates, which reduces the opening between the cheek plates but permits lateral access to the sheave for a cable or the like.

In order more clearly to illustrate the invention an embodiment thereof is described hereunder purely by way of example with reference to the accompanying drawings wherein.

Referring to FIGS. 1 to 4 a snatch block comprises a pair of spaced cheek plates 10 with a sheave 13 rotatably mounted between the cheek plates 10 by means of a transverse nut and bolt arrangement 14.

Figure 1:
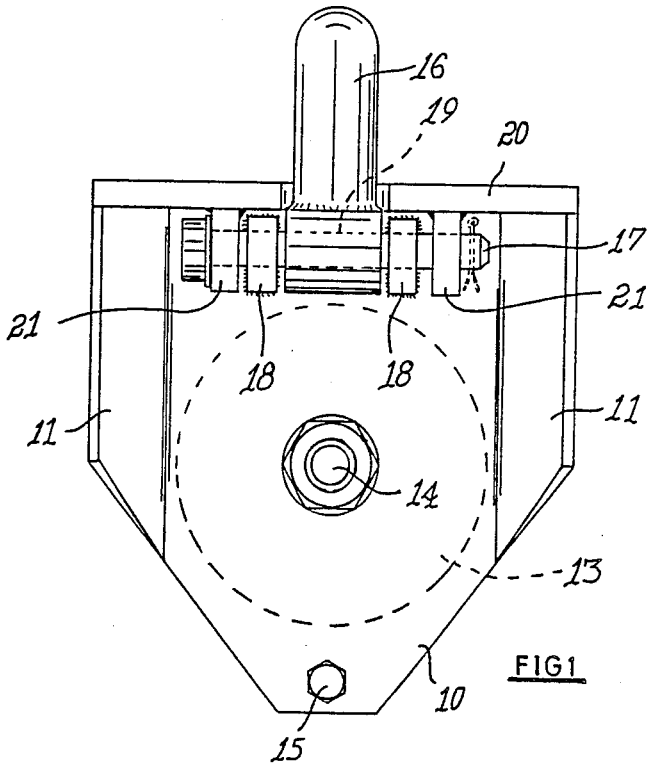
FIG. 1 is an elevation of a snatch block.
Figure 2:
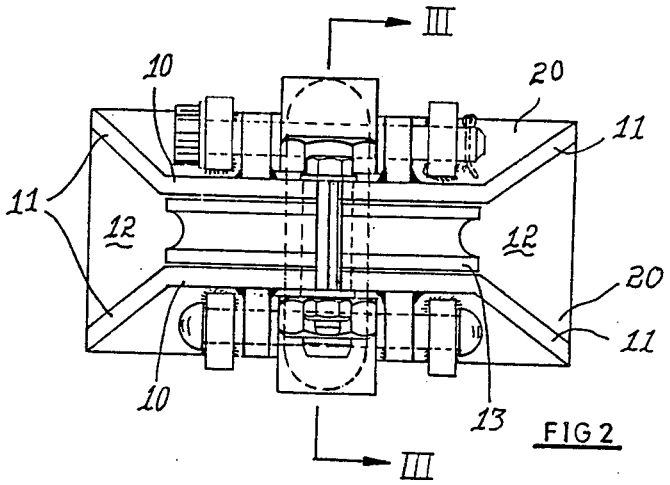
FIG. 2 is a bottom elevation of the snatch block in FIG. 1.
Figure 3:
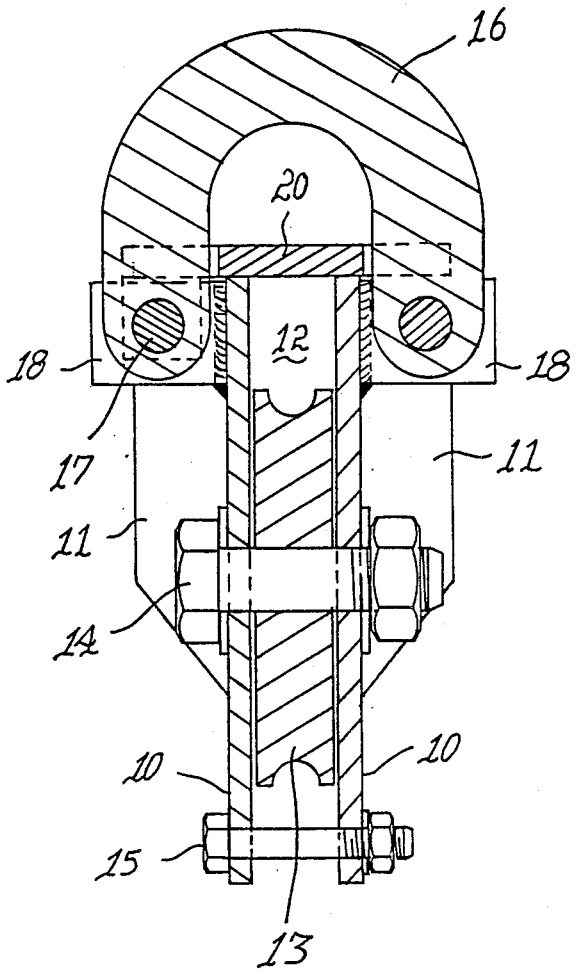
FIG. 3 is a section on line III—III in FIG. 2.

A feature of the invention provides for the vertical side zones 11 of the cheek plates to be bent outwardly away from the sheave so that a substantially V-shaped entry zone 12 to the sheave is formed for passage of a cable, chain or the like which will run on the sheave in use. Preferably the side zones 11 will be bent on a substantially vertical axis as shown in FIG. 1 and it will be noted that the angled zones 11 extend to just below the mounting bolt 14 of the sheave 13. Below the angled sides 11 the cheek plates 10 will preferably diverge towards a central bottom cheek plate spacer 15.

The invention is further characterised in the provision of a closure plate 20 which is adapted in use to enclose the top zone of cheek plates 10 to trap a cable between the cheek plates 10 and the sheave 13 and thus to prevent the cable from riding up into an eye formation 16 from which the snatch block is suspended in use. It will be noted that the closure plate 20 is of flat configuration and substantially horizontally disposed, and that the top edge of the cheek plates 10 is linear to mate with the closure 20.

In order to permit a rope of endless type to enter the snatch block it is envisaged that the closure plate 20 will be removable and preferably will be hinged to one of the cheek plates 10 for movement between an open and closed position. With reference to the drawings a suitable hinge could be formed by a hinge pin 17 which passes through spaced apertured lugs 18 secured to the cheek plate 10, the hinge pin 17 also passing through spaced apertured lugs 21 which are secured to and depend downwardly from the closure member 20. The hinge described above will preferably be provided on both cheek plates 10 with one of the hinge pins 17 being removable to enable its hinge to be opened. Such removable hinge pin 17 will therefore also serve to lock the closure plate 20 in the closed position.

Figure 4:
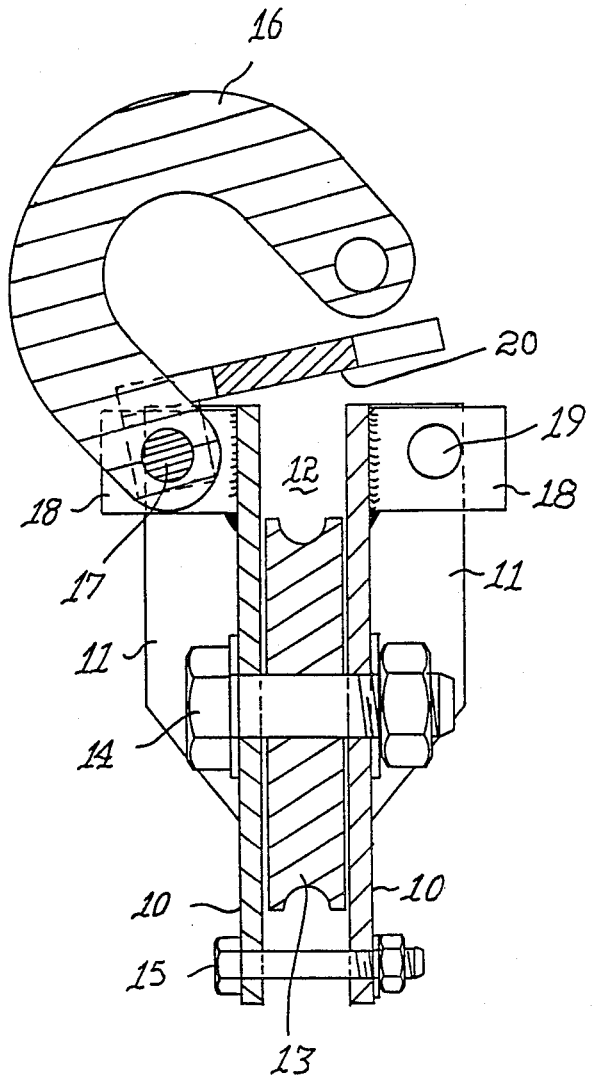
FIG. 4 is a section on line III—III in FIG. 2 with suspension means for the snatch block in its open position.

Preferably the suspension eye 16 will also be incorporated in the hinges above, with the hinge pin 17 passing through apertures 19 provided at each end of the eye 16, FIG. 1. FIG. 4 illustrates a situation wherein the hinge pin 17 on the righthand side of the snatch block has been removed to enable both the suspension eye and closure plate 20 to swing to their open positions.

Figure 5:
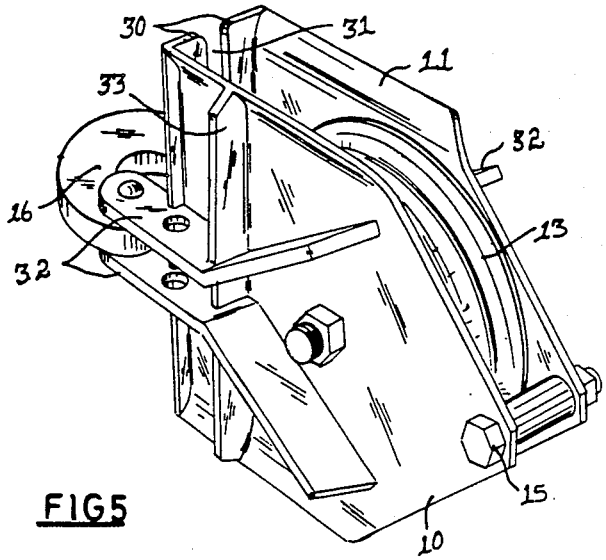
FIG. 5 is a perspective view of a different embodiment of the snatch block in FIG. 1.
Figure 6:
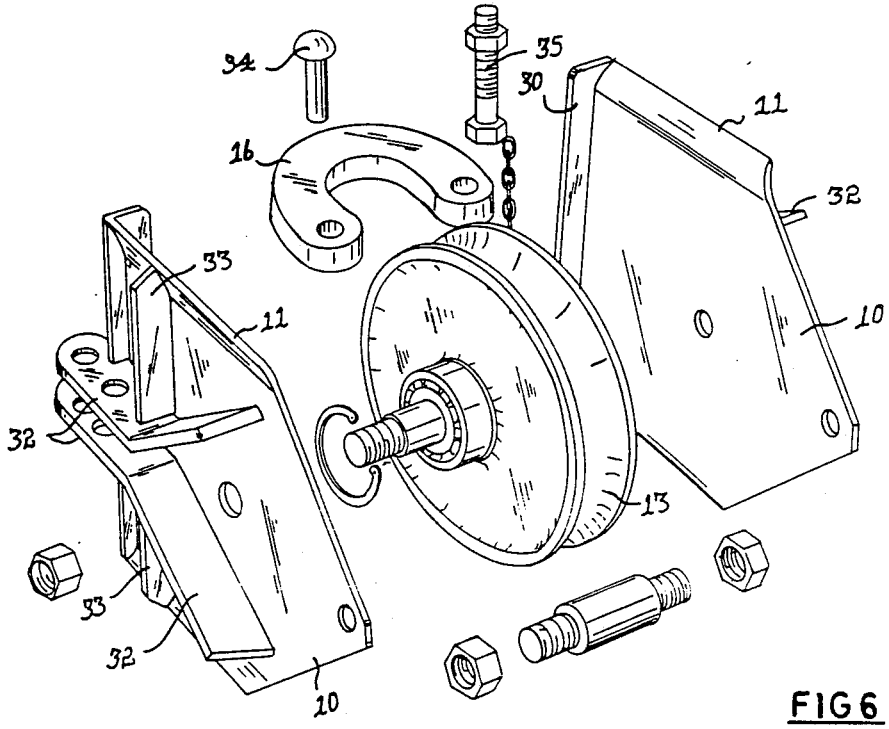
FIG. 6 is an exploded perspective view of the snatch block in FIG. 5.

The snatch block illustrated in FIG. 5 and FIG. 6 differs from the one described above in that the closure plate 20 is dispensed with and in its place a pair of opposed plate members 30 are permanently fixed to the upper edge of each cheek plate 10 to provide opposed inwardly directed lip formations which are spaced from one another to permit a cable, wire, rope or the like to be passed through the spacing 31 between the lip formations. In the arrangement in FIG. 5 and FIG. 6 the suspension eye 16 is pivotally mounted at its two free ends between a pair of lug formations 32 secured to each cheek plate 10. The suspension eye 16 could be coupled to the lug formations 32 by means of a hinge pin 34 and a removable nut and bolt 35 which passes through the respective elements. It is proposed that the lug formations 32 will extend along the face plates 10, and terminates in the zone of the axis of the sheave 13, to act as reinforcing ribs for the cheek plates 10. Preferably the formations 32 will diverge in the zone of the axis of the sheave 13 as illustrated. Preferably also transverse reinforcing will be provided for each cheek plate 10 in the form of a rib 33 which extends between the angled sides 11 of the cheek plates.

Doubtless many variations of the invention exist which differ in matters of detail but do not depart from the principles set out in the consistory clauses. It is believed that the arrangement of the invention will provide a snatch block wherein a wire rope or the like passing therethrough will ride on the sheave 13 is most situations.

I claim:

1. A snatch block comprising a sheave member of a predetermined diameter rotatably mounted between a pair of cheek plates, said sheave on an axis generally orthogonal to said plates, suspension means on the cheek plates for anchoring the snatch block in use, each cheek plate having a width, as measured across its surface orthogonal to said axis, a closure plate in abutment with said cheek plates at one end thereof, said cheek plates being wider than said diameter at said one end and tapering to a width less than said diameter at their other end, opposed sides of each cheek plates being angled away from the sheave to provide a V-shaped entry to the sheave for a cable, said closure plate being in continuous abutment with at least said angled away portions of said cheek plates and generally orthogonal thereto.

2. The snatch block according to claim 1 wherein closure plate is provided which is adapted to reduce or close the opening between the cheek plates intermediate the sheave and the suspension means.

3. The snatch block according to claim 2 wherein the closure plate is in the nature of a plate member hinged to one cheek plate for pivotal movement between a closed position wherein it bridges the cheek plates and an open position wherein it permits lateral access to the sheave for a rope, cable or the like.

4. The snatch block according to claim 3 wherein the suspension means is in the form of an eye formation which is adapted to bridge the sheave when in its closed position, and a first common hinge is provided and serves pivotally to mount the eye formation and the closure means.

5. The snatch block according to claim 4 wherein a second hinge is provided to lock the closure member and the eye formation in their closed positions, with hinge pin of the second hinge being removable to permit these members to move to their open positions.

6. The snatch block according to claim 1 wherein the closure plate defines an inwardly directed lip formation on one or both cheek plates.

7. The snatch block according to claim 6 wherein the closure plate defines a pair of opposed inwardly directed lip formations, one on each cheek plate, with the spacing between the lip formations being adapted to permit lateral access to the sheave for a rope, cable or the like.

* * * * *